US006725675B2

(12) United States Patent
Kampert et al.

(10) Patent No.: US 6,725,675 B2
(45) Date of Patent: Apr. 27, 2004

(54) FLAKED ICE MAKING MACHINE

(75) Inventors: Matthew E. Kampert, Manitowoc, WI (US); Charles E. Schlosser, Manitowoc, WI (US); Lee G. Mueller, Kewaunee, WI (US)

(73) Assignee: Manitowoc Foodservice Companies, Inc., Sparks, NV (US)

( * ) Notice: Subject to any disclaimer, the term of this patent is extended or adjusted under 35 U.S.C. 154(b) by 0 days.

(21) Appl. No.: 10/268,431

(22) Filed: Oct. 9, 2002

(65) Prior Publication Data

US 2003/0089120 A1 May 15, 2003

Related U.S. Application Data

(60) Provisional application No. 60/328,239, filed on Oct. 9, 2001.

(51) Int. Cl.[7] ..... F25C 1/14

(52) U.S. Cl. ..... 62/71; 62/188; 62/303; 62/354

(58) Field of Search ..... 62/66, 71, 188, 62/340, 354, 303, 347, 348

(56) References Cited

U.S. PATENT DOCUMENTS

| | | | | | |
|---|---|---|---|---|---|
| 2,997,861 | A | * | 8/1961 | Kocher et al. | 62/347 |
| 3,365,901 | A | | 1/1968 | Guard | |
| 3,740,963 | A | * | 6/1973 | Lyman et al. | 62/66 |
| 4,262,489 | A | * | 4/1981 | Sakamoto | 62/124 |
| 4,622,826 | A | | 11/1986 | Tsukiyama et al. | |
| 4,644,757 | A | * | 2/1987 | Hida et al. | 62/188 |
| 4,782,667 | A | | 11/1988 | Kito et al. | |
| 4,787,539 | A | | 11/1988 | Uchida et al. | |
| 4,932,223 | A | | 6/1990 | Paul et al. | |
| 5,020,336 | A | | 6/1991 | Hida | |
| 5,109,679 | A | | 5/1992 | Hida | |
| 5,142,878 | A | | 9/1992 | Hida et al. | |
| 5,189,891 | A | | 3/1993 | Sakamoto | |
| 5,197,300 | A | | 3/1993 | Sakamoto et al. | |
| 5,289,691 | A | * | 3/1994 | Schlosser et al. | 62/78 |
| 5,293,757 | A | | 3/1994 | Nishio | |
| 5,394,708 | A | | 3/1995 | Whinery et al. | |
| 5,477,694 | A | | 12/1995 | Black et al. | |
| 5,501,081 | A | * | 3/1996 | Mori et al. | 62/135 |
| 5,605,050 | A | | 2/1997 | Tatematsu et al. | |
| 5,644,927 | A | | 7/1997 | Tatematsu et al. | |
| 5,664,434 | A | | 9/1997 | Sugie et al. | |
| 5,860,564 | A | | 1/1999 | Jablonski | |
| 5,884,502 | A | | 3/1999 | Jones et al. | |
| 5,910,164 | A | | 6/1999 | Snelling et al. | |
| 5,911,749 | A | | 6/1999 | Sugie | |
| 5,974,823 | A | | 11/1999 | Banno et al. | |
| 5,987,900 | A | * | 11/1999 | Love | 62/66 |
| 6,039,220 | A | | 3/2000 | Jablonski et al. | |
| 6,311,501 | B1 | | 11/2001 | Allison et al. | |
| 6,347,529 | B1 | | 2/2002 | Yamamoto | |
| 6,381,975 | B1 | * | 5/2002 | Tsuchikawa | 62/233 |

* cited by examiner

*Primary Examiner*—William E. Tapolcai
(74) *Attorney, Agent, or Firm*—Brinks Hofer Gilson & Lione

(57) ABSTRACT

A flaked ice making machine has a solenoid inlet valve in series with an inlet level control valve. In a preferred embodiment, these valves are used to provide an automatic cleaning feature. The automatic self-cleaning feature interacts with the control system and an array of inputs to clean a water reservoir and a freezing cylinder within the ice making machine and to rid the machine of mineral deposits.

42 Claims, 12 Drawing Sheets

Water Drain Sequence

Water Fill Sequence

Refrigeration System Start-up

Ice-Making Sequence

Full Ice Bin Detection, Refrigeration System Shut Down

Full Ice Bin Detection, Drain Sequence

Cleaning Sequence

FLAKED ICE MAKING MACHINE

This application claims the benefit of the filing date under 35 U.S.C. § 119(e) of Provisional U.S. Patent Application Ser. No. 60/328,239, filed on Oct. 9, 2001, which is hereby incorporated by reference in its entirety.

FIELD OF THE INVENTION

The present invention relates to ice making machines, and particularly to ice making machines that make flaked ice using an auger in a freezing cylinder.

BACKGROUND OF THE INVENTION

Flaked ice is popular because flaked ice has a large surface area, and may be used to quickly cool a variety of items, including beverages, foods, injuries to people, and so on. Flaked ice may be made by size reduction of larger-sized ice cubes or particles, or in machines specially designed for making flaked ice. Such machines generally consist of a cylindrical chamber into which water is admitted, with a screw-type auger rotating in the center of the chamber. Cooling coils are generally attached to the outside surface of the cylinder, the cooling coils being the cooling portion of a refrigeration system used in the flaked ice-making machine.

Water is admitted to the bottom of the cylinder, and the auger is rotated slowly. Heat is removed from the water in contact with the cylindrical walls, which are in turn in contact with the cooling coils. As the water is progressively chilled, it freezes into ice. The ice is then shuttled out of the freezing cylinder and into a storage bin or holding unit for use. Water coming into the cylinder is usually held between certain levels in a water tank or reservoir, requiring replenishment when the water level is low, and the water supply must be shut off when the water level reaches a certain level.

Present flaked ice making machines are in need of improvement in several ways. When water is progressively frozen, the portion of the water that freezes tends to be more pure than the portion that remains. Thus, the auger and the cylinder tend to build up levels of impurities or minerals left behind when water freezes. Ice levels in the holding bin are difficult to measure. Present methods may involve intrusive sensors or paddles to detect ice levels. These sensors are unreliable and tend to block the flow of ice to the bin. The high-level and low-level sensors usually used to determine water level in the water tank tend to be unreliable. Finally, the compressor in the refrigeration system tends to cycle on and off rather than shut off completely in a bin-full condition, when there is no further demand for making ice. This condition should be avoided.

A flaked ice machine that could be easily cleaned of the mineral deposits would be an improvement over presently-available machines. A flaked ice machine that had an ice level sensor that does not interfere with the production or transport of ice would also be desirable. It would also be an improvement to have a flaked ice machine whose control system could sense when more ice is not needed and would turn off the compressor.

SUMMARY

An improved ice making machine has been invented which is easily cleaned, has an ice level sensor that does not interfere with ice production, and has a control system which shuts down the compressor when the bin is full. An improved machine for making flaked ice has a water system, a refrigeration system, and a microprocessor-based controller. The water system comprises at least one water inlet, a level control inlet valve and an independently operated inlet valve operably connected to the inlet, the valves in series with the inlet, a reservoir for receiving water from the inlet and the valves, the reservoir also containing at least one water outlet. The water system also comprises a freezing cylinder communicating with the water reservoir, the freezing cylinder further comprising an auger having a screw edge and a motor for rotating the auger, and a discharge valve. The refrigeration system comprises a compressor, a condenser, an expansion device and cooling coils in heat transfer relationship with the freezing cylinder for receiving coolant from the expansion device to cool water from the water system. The microprocessor-based controller controls the independently operated inlet valve.

Another aspect of the invention is a method of operating a flaked ice making machine. The method comprises the steps of adding water to a reservoir through a solenoid inlet valve in series with a float valve. The method includes transferring water from the reservoir to a cylinder containing an auger. The auger is rotated and heat is exchanged between the water and the environment, causing the water to freeze. The method then includes removing ice formed by said freezing from said cylinder.

Another aspect of the invention is a flaked ice making machine comprising a water reservoir, a water inlet, a freezing cylinder, an ice chute and a controller. The water reservoir further comprises a water level sensor, a water outlet, and a discharge valve. The water inlet further comprises an inlet float valve and a solenoid inlet valve, operably connected in series to fill the water reservoir. The freezing cylinder is operably connected to receive water from the outlet of the water reservoir, and the freezing cylinder further comprises an auger having a screw edge therein and a motor to rotate said auger, and the freezing cylinder also comprises cooling coils on the outside thereof connected to a compressor and a condenser for exchanging heat to freeze water inside the cylinder. The ice chute is for receiving ice from said freezing cylinder and further comprises an ice chute sensor within the ice chute. The controller is operative to control making of flaked ice by closing the solenoid valve and turning off the motor and the compressor upon receiving a signal from the ice chute sensor.

Another aspect of the invention is a flaked ice making machine. The flaked ice making machine comprises a water reservoir, including a water level sensor, a water outlet and a discharge valve, and also comprises a water inlet valve operably connected to fill the water reservoir. The ice machine further comprises a freezing cylinder operably connected to receive water from the outlet of the water reservoir, the freezing cylinder further comprising an auger having a screw edge therein and a motor to rotate said auger, and cooling coils on the outside thereof connected to a compressor and a condenser for exchanging heat to freeze water inside the cylinder. The flaked ice making machine also comprises an ice chute communicating with the freezing cylinder for receiving ice from the freezing cylinder, the ice chute further comprising a capacitive sensor for determining an ice level within said chute. The machine also comprises a controller, wherein the controller is operative to control making of flaked ice by opening and closing the water inlet valve and the discharge valve, and by turning on and off the motor and the compressor.

Another aspect of the invention is a method of operating a flaked ice making machine having a capacitive ice bin sensor. The method comprises adding water to a reservoir though an inlet valve, and transferring water from the reservoir to a cylinder containing an auger. The method then includes rotating the auger, and exchanging heat between the water and an environment, wherein the water freezes. The method also includes removing ice formed by said freezing from said cylinder and ceasing to make ice upon a signal from a controller or a power interrupt.

The advantages of the machine for making flaked ice include a more reliable water inlet system, using both a level control valve and an independently-controlled valve. This dual-valve system also makes it much easier to run a cleaning cycle as needed or as desired, without the need for manual control of the valves for rinse water. A special non-intrusive sensor in the ice-bin may give a reliable signal or indication of a bin-full condition, enabling the controller to shut down the refrigeration equipment, rather than running the refrigeration equipment when it is not needed. These and other aspects and advantages of the invention will be made clearer in the accompanying drawings and explanations of the preferred embodiments.

DETAILED DESCRIPTION OF THE PREFERRED EMBODIMENTS

Figure 1:
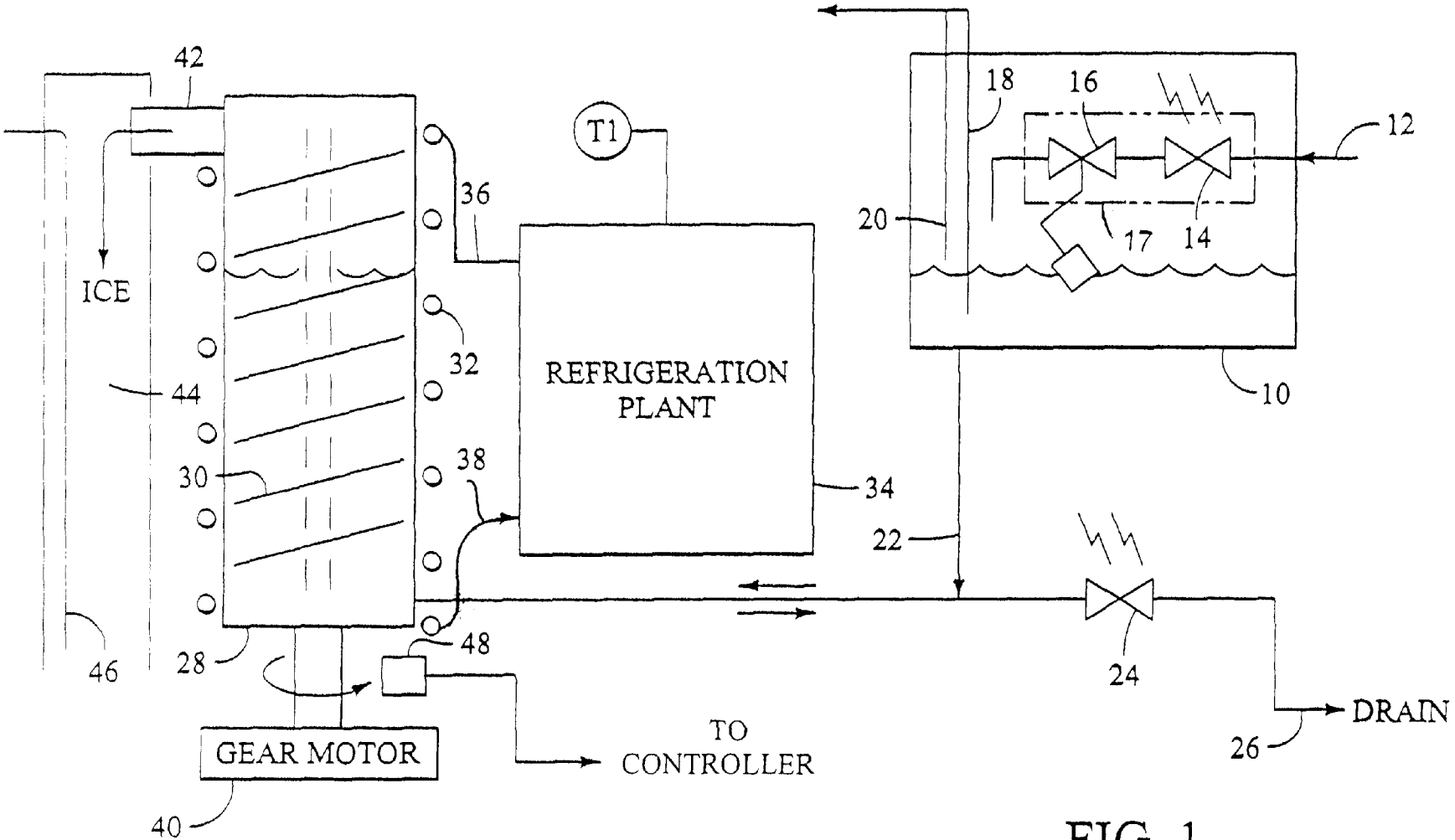
FIG. 1 is a schematic diagram of a preferred embodiment of a flaked ice making machine of the present invention.

FIG. 1 is a schematic drawing of a preferred embodiment of the present invention incorporating a number of innovative features. The water system includes a water reservoir 10 having a potable water inlet line 12 and an independently operated valve, such as solenoid valve 14, and a level control valve, such as float valve 16. In one embodiment, the solenoid valve and the float valve are installed as a single part, a float valve-solenoid valve combination 17. The solenoid valve 14 may be a normally closed valve in series with the float valve 16. An advantage of the solenoid valve in series with the float valve is another degree of freedom in control when operating the flaked ice machine. The float valve may be mechanically linked to the water level in the reservoir as shown, with the level probe functioning more as an indicator or an alarm rather than directly controlling the level of water in the reservoir. The solenoid valve 16 may thus be responsive to water level sensors or probes 18 and 20. The sensors may be any sensors suitable for use in potable water, and are desirably non-contaminating. Capacitive and conductive probes are examples of useful probes. A high level probe may also be used in conjunction with the solenoid valve.

When the ice machine starts up, probes 18 and 20 may shut the machine off if water is not sensed. The water reservoir 10 and its outlet line 22 also are equipped with a solenoid drain valve 24 and a drain line 26. A drain valve in this location gives a further degree of control and eliminates any need for a drain valve downstream in the flaked ice machine cylinder.

Water leaves the water reservoir and flows though the outlet line 22 to the refrigeration system. Water from the outlet line 22 at its hydraulic level is thus present in a freezing cylinder 28. Freezing cylinder 28 is equipped with an auger-type screw 30 on its inside, and cooling coils 32 on its outside. In one type of flaked ice machine, cool refrigerant from a refrigeration plant 34 enters near the top 36 of the cylinder and leaves at the bottom 38, in a counter-current heat-exchange flow. This is not strictly necessary, as any arrangement that allows a refrigerant to cool the water and freeze it into ice as the auger turns will work. Preferably the refrigeration plant produces a liquid refrigerant that vaporizes in the cooling coils 32. The ice now travels slowly up the auger as a motor 40 rotates the auger. Ice is discharged via passage 42 into an ice bin or chute 44. The refrigeration plant 34 may have one or more temperature indicators T1 for local or remote sensing of temperatures associated with the refrigeration plant and process.

Portions of the control system are also evident in FIG. 1. The level of ice in the chute is monitored by ice bin level sensor 46. The speed of the auger is measured by auger speed sensor 48. In one embodiment, the ice bin level sensor 46 is a capacitive sensor, reacting to the level of ice in the bin as it impinges on the surface of the sensor. The auger speed sensor 48 is any sensor suitable for measuring rotational speed, such as an encoder or a Hall-effect sensor.

Figure 2:
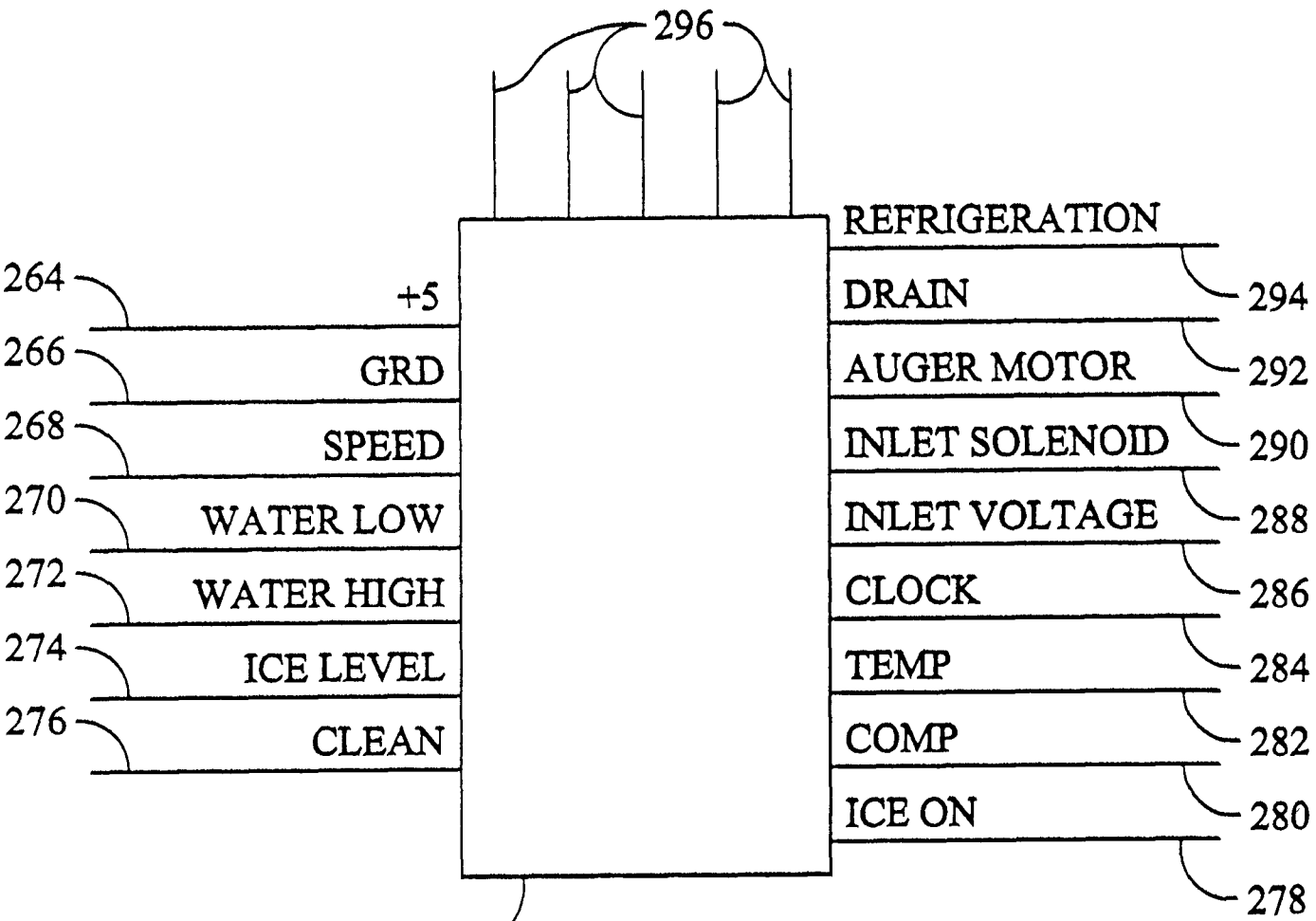
FIG. 2 is a block diagram of a controller used on the flaked ice making machine of FIG. 1.

FIG. 2 is a block diagram of inputs to a controller according to the present invention. Controller 262 is desirably a microprocessor or microprocessor-based controller, with the ability to accept multiple inputs and provide multiple outputs. Inputs include, but are not limited to, a voltage 264 and a ground 266 for the controller; auger speed input 268, which comes from sensor 48; water low input 270 and water high input 272, which come from probes 18 and 20; ice level high indication input 274, which comes from sensor 46; clean switch "on" input 276; ice making switch "on" input 278; compressor pressure indication input 280; compressor temperature indication input 282; oscillator or clock 284; and flaker input voltage 286.

Outlets from the controller may include, but are not limited to, inlet solenoid signal 288, to operate solenoid 14; motor run signal 290, to run gear motor 40; drain solenoid valve signal 292, to operate drain valve 24; refrigeration system signal 294, to operate refrigeration plant 34; and other output signals 296. Any of these outputs may be connected to running lights or alarms responsive to desired inputs or outputs to the controller.

Figure 3:
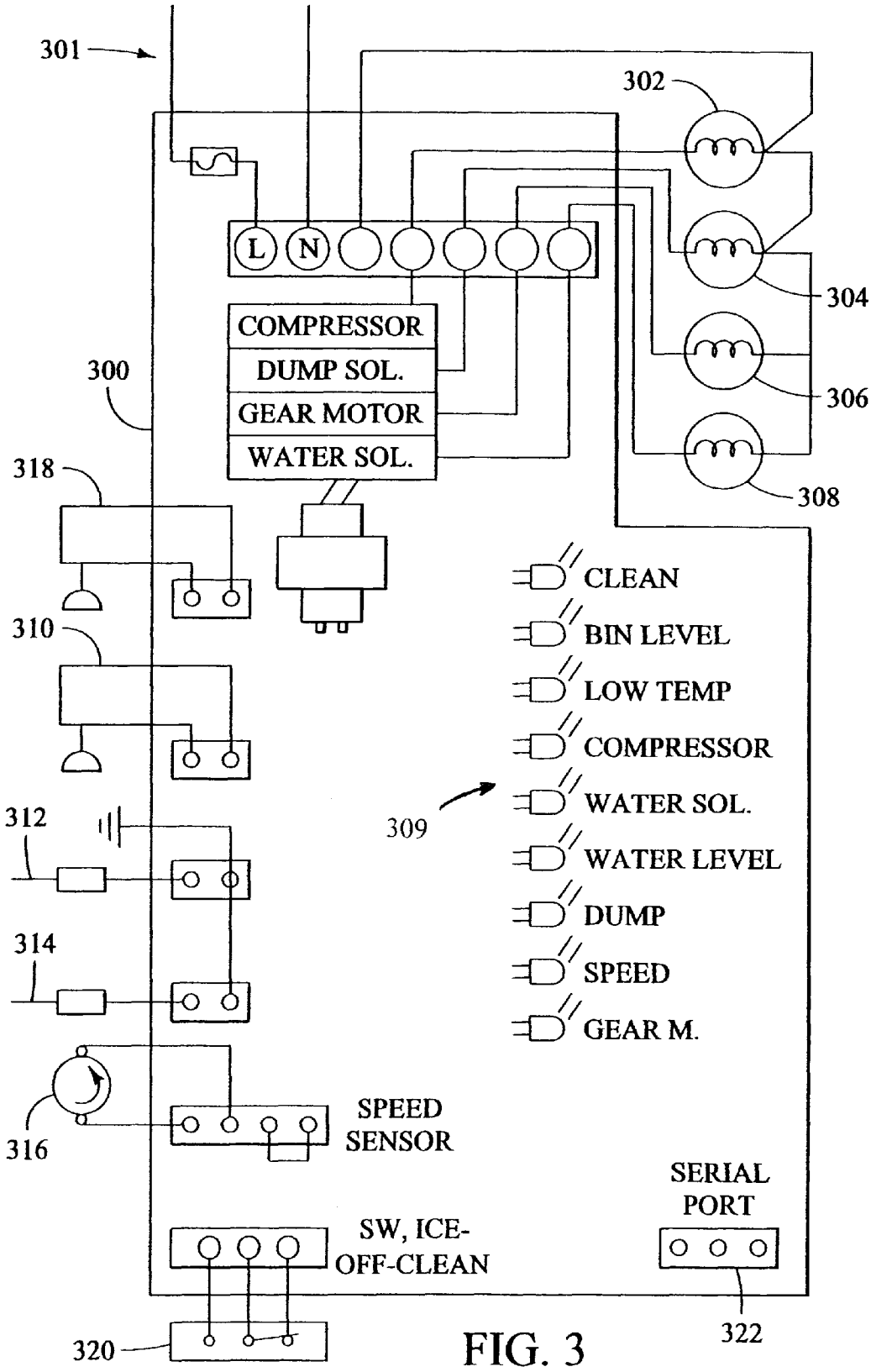
FIG. 3 is a wiring diagram of the flaked ice making machine of FIG. 1.

FIG. 3 is a wiring diagram according to one embodiment of the flaked ice machine of FIG. 1. Control panel 300 has input power 301 to route power to the electrically-powered items. These include, for example, power to a refrigeration plant compressor 302, a solenoid coil 304 for drain valve 24, a motor 306 to drive the auger motor 40, and a water solenoid coil 308 for solenoid inlet valve 14. Wiring inputs to the control panel include an input 310 for high and low compressor temperature, low water level input 312, ice level sensor input 314, auger speed input 316, and high water level input 318. It may also be useful to have a switch 320 for selection between positions for normal "make ice" operation, "off", and "cleaning/rinsing" functions. Other portions of the wiring diagram may include one or more running lights, such as light-emitting-diodes (LEDs) 309, to indicate running or active status for the stated component during a clean or flush cycle. At least one additional serial port 322 may also be added for use for an input or output device, such as a switch to start a cleaning cycle, or an LED to alert the owner or operator that a cleaning cycle is needed.

The motor 40 used to rotate the auger 30 contained within freezing cylinder 28 may be any motor capable of rotating the auger under relatively light loads, typically a fraction of a horsepower. Motors that have been found suitable include induction motors and small gear motors. It is desirable in such a flaked ice machine to incorporate sensor 48 for indicating the speed of the auger. This speed is most useful when the machine is put into operation to make ice, that is, upon the start of a cycle. It is important to detect whether the motor does not start. It is also important not to overload the small motor, in the case where ice has somehow formed on the auger, or the screw portion or flights of the auger, freezing the rotating auger 30 to the stationary cylinder 28. In this case, the auger will not come up to speed when started.

A sensor 48 that can detect low speed is therefore used to shut off power to the motor 40 until the ice has melted or other obstruction has been cleared. Hall-effect sensors develop an electric field when moved across a current-carrying material. Thus, a sinusoidal voltage is generated when a Hall-effect sensor detects motion, as in a motor or an auger turning. Other sensors may also be used, such as encoders, or any other sensor useful for sensing and transmitting the rotational speed of the auger.

The refrigeration system or plant 34 is used to provide cool refrigerant to the flaked ice machine. The refrigeration system should be instrumented for safety reasons. Inputs to the flaked ice machine control panel typically include a compressor outlet temperature 517, a refrigerant pressure 294, and whether the thermal expansion valve is flooded, typically indicated by a low temperature at the valve 284. While these sensors and their inputs to a controller are not strictly necessary for operation of the flaked ice, their use can help to achieve better performance and long life of the machine.

In one embodiment, a water level sensor with probes 18 and 20, to detect a low level of water in the reservoir, may be a capacitive sensor or may be a conductivity sensor, wherein a greater level of conductivity between two probes indicates the presence of water. The sensor may be any desired type of sensor, so long as it senses the presence of water. An indication to the controller of no water or low water level is necessary to shut off the flaker machine. In other embodiments, a high water level sensor (not shown) may be useful to shut off the water, via the solenoid inlet valve 14, in the event that the float valve 16 fails.

The float valve 16 does not need to be electrically operated, nor is it necessary to operably connect with the controller. Thus the float valve may be a strictly mechanical valve, wherein the valve opens and admits water to the reservoir when the level falls, and the valve closes when the level has risen to a sufficient level. The water level sensors mentioned above may also help control the flow of water to the reservoir, as described above. If desired, the float valve may instead be electrically controlled directly by level sensors, but a reliable float valve will suffice. A useful valve for this application is a combination solenoid and float valve 17, in a small package, such as those manufactured by A+K Muller, Dusseldorf, Germany. An exemplary valve is model 84150. Some embodiments of the ice machine may have only a single valve, for instance, embodiments with a capacitive ice chute sensor that does not block the flow of ice, as described below.

The preferred embodiment of the invention features ice level sensor 46 for determining the level of ice in the chute 44. This sensor 46 is desirably a sensor that does not interfere with the flow of ice from the freezing cylinder 28 to the ice chute 44. In the past, sensors such as paddle-wheels have been used, which tend to interfere with the flow of flaked ice and clog the passageway. Any ice level sensor that will not contaminate the ice nor interfere with its movement will suffice. One such sensor is a capacitive sensor in the form of a thin, flat sheet, inserted into the chute, near one wall. Such a sensor will be sensitive to the level of ice in the chute, which affects the oscillations in a signal to and from the sensor control. Other capacitive sensors, such as cylindrical level sensors, indicative of the presence of a liquid at a particular level, will not work as well since they may tend to interfere with the movement of the ice.

A thin, flat, sheet-like capacitive sensor, such as one made by Manitowoc Ice, Inc., model number 003001113, works well in this application. Such a sensor works with a controller (not shown), such as model number 002000973, made by United Technologies Electronic Controls, East Hartford, Conn. The controller causes a voltage oscillation within the sensor at a certain rate. When the oscillation is damped by the presence of ice, the decrease in oscillation is suggestive of a level of ice in the chute. While this capacitive sensor is preferred, other thin, non-obstructing capacitive sensors will also work in this application. Some of these function in a continuous fashion, others by a series of small capacitive sensors in an elongated, thin, flat structure. Such sensors are available from Globetron Corp., Oakville, Ontario, Canada. Upon receiving a "bin full" signal from the sensor, the flaked ice making machine will cease to make ice for at least a period of time.

Figure 4:
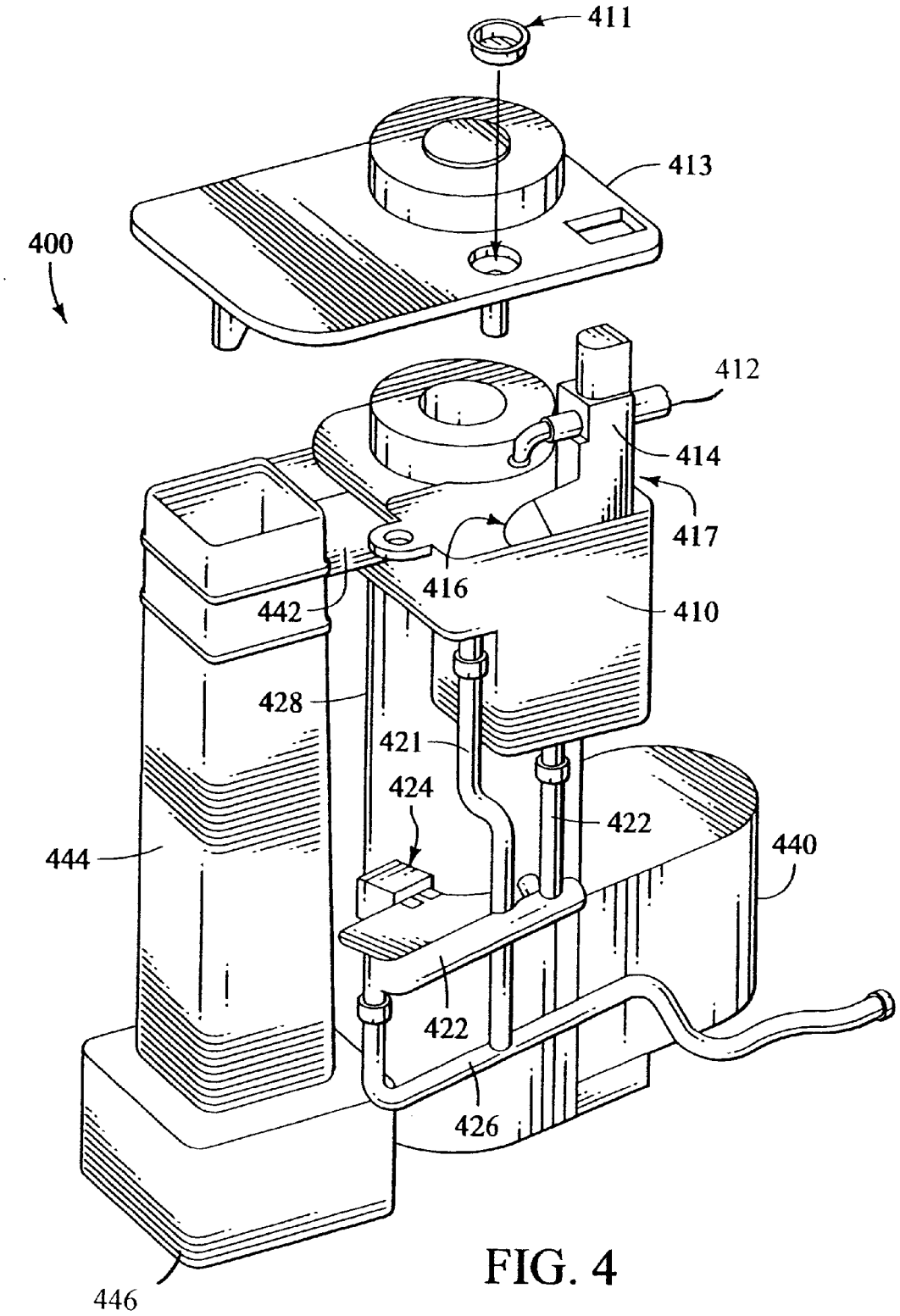
FIG. 4 is an isometric view of the flaked ice making machine of FIG. 1.

FIG. 4 provides an isometric view of a flaked ice machine embodiment 400, utilizing the features of schematic FIG. 1. Similar components in the two figures carry similar reference numerals with an addend of 400. A source of water is connected to the flaked ice machine through water inlet connector 412, preferably having a quick-disconnect fitting. Water enters the water reservoir 410 through the combination valve 417, which comprises the solenoid inlet valve 414 and the float valve 416. The outlet line 422 of the water reservoir supplies water to the bottom of the freezing cylinder 428 and also deadheads against the drain solenoid valve 424. Overflow line 421 from the water reservoir leads from a top portion of the reservoir downstream of the drain solenoid valve, to a drain line 426. In the event of an overfill condition of the float valve, the extra water is removed from the water reservoir and flows freely toward the drain. This embodiment of the invention features a cap 411 over the freezing cylinder and the water reservoir, with a removable portion 413 so that cleaning solution (not shown) may be poured into the water reservoir 410. The cleaning solution may be any of those commonly used to de-lime or de-mineralize water conditioning equipment, or any other cleaning or sanitizing solution desired by a user. As depicted in FIG. 4, in this embodiment of the invention, a flaked ice machine 400 has a bottom portion of the freezing cylinder 428 connected to the water reservoir 410 through a outlet line 422, so that the water level in the water reservoir is approximately the same as the water level in the freezing cylinder. The flaked ice machine also features a motor 440, such as a gear motor, to turn the internal auger (not shown) when making ice. Ice is expelled from the freezing cylinder 428 through passage 442 and into chute 444. An insulator or adapter 446 may connect chute 444 to an ice bin (not shown).

One method of practicing the invention is to make flaked ice and then to clean the flaked ice machine. The method includes the steps of adding water to a cylinder 28 containing a screw-type auger 30, and then rotating the auger. The flaker exchanges heat between the water and coolant in its environment, causing the water to freeze into ice. The flaker continues to rotate, ejecting ice from a top portion of the cylinder, and causing the ice to be stored in a chute 44. Upon a signal from a controller 262 controlling the flaker, the ice machine ceases to make ice. The method also includes cleaning the cylinder 28 by the process described above for adding a cleaning solution, followed by several rinsing cycles. Another embodiment of the invention is the use of a sensor 48 to determine the speed of the auger 30, typically an RPM signal.

With valve 417 and a suitable controller, it is not necessary to manually turn off the water inlet supply. Rather, when the controller is running a normal operation of making ice, the solenoid valve 414 is open, allowing the float valve 416 to control the level in the water reservoir 410. When the machine is turned off, the controller may cause the solenoid to close, since there is no need for inlet water if the machine is turned off. When the flaker is going through a cleaning cycle, the solenoid will first allow the water reservoir to drain and will negate the signal from the float calling for filling the reservoir when the level of water in the reservoir has fallen. Later in the cleaning cycle, when adding cleaning solution, the controller may open the solenoid inlet valve, causing water to enter the water reservoir until the float valve determines that the reservoir is full. Steps are subsequently taken to drain the reservoir and cylinder of the cleaning solution, followed by several fill and rinse cycles. It is the use of the combination float and solenoid inlet valve that make this method easy and convenient. It is not necessary to repeatedly open and close an inlet valve manually.

The refrigeration system may be monitored in this application by a sensor or an input to the flaked ice machine controller 262. This input may be a compressor outlet temperature T1 (FIG. 1), as when an outlet temperature of the compressor is too low. This input may be a pressure of the refrigerant of the refrigeration system, as when there is insufficient pressure. Alternatively, the input may be one indicative of a flooded thermal expansion valve 513 (TXV) (see FIG. 5) of the refrigeration system.

In operation, a refrigeration system 500 contains an appropriate refrigerant, such as carbon dioxide or various halogenated or hydro-halogenated hydrocarbons, and begins operation during what is referred to as the freeze cycle. In the freeze cycle the compressor 514 receives a vaporous refrigerant at low pressure and compresses it, thus increasing the temperature and pressure of this refrigerant. The compressor then supplies this high temperature, high-pressure vaporous refrigerant to the condenser 511 where the refrigerant condenses, changing from a vapor to a liquid, and in the process the refrigerant releases heat to the condenser environment. In large ice making systems the condenser may be located out-of-doors far away from the compressor operating within the confines of the icemaker machinery.

The liquid refrigerant is normally supplied from the condenser 511 to the evaporator 512 where the liquid refrigerant changes state to a vapor and, in the process of evaporating, absorbs latent heat from the surrounding environment. This cools the evaporator and any materials in close proximity to or in contact with the evaporator. The refrigerant is converted from a liquid to a low-pressure vaporous state and is returned to the compressor 514 to begin the cycle again. During this so-called freeze cycle, the wall of the freezing cylinder 28, and coils 32 making up evaporator 512, are cooled to well below 0° C., the freezing point of water. Often temperatures below −10° C. or even temperatures of −25° C. or below can be achieved in coils 32.

Figure 5:
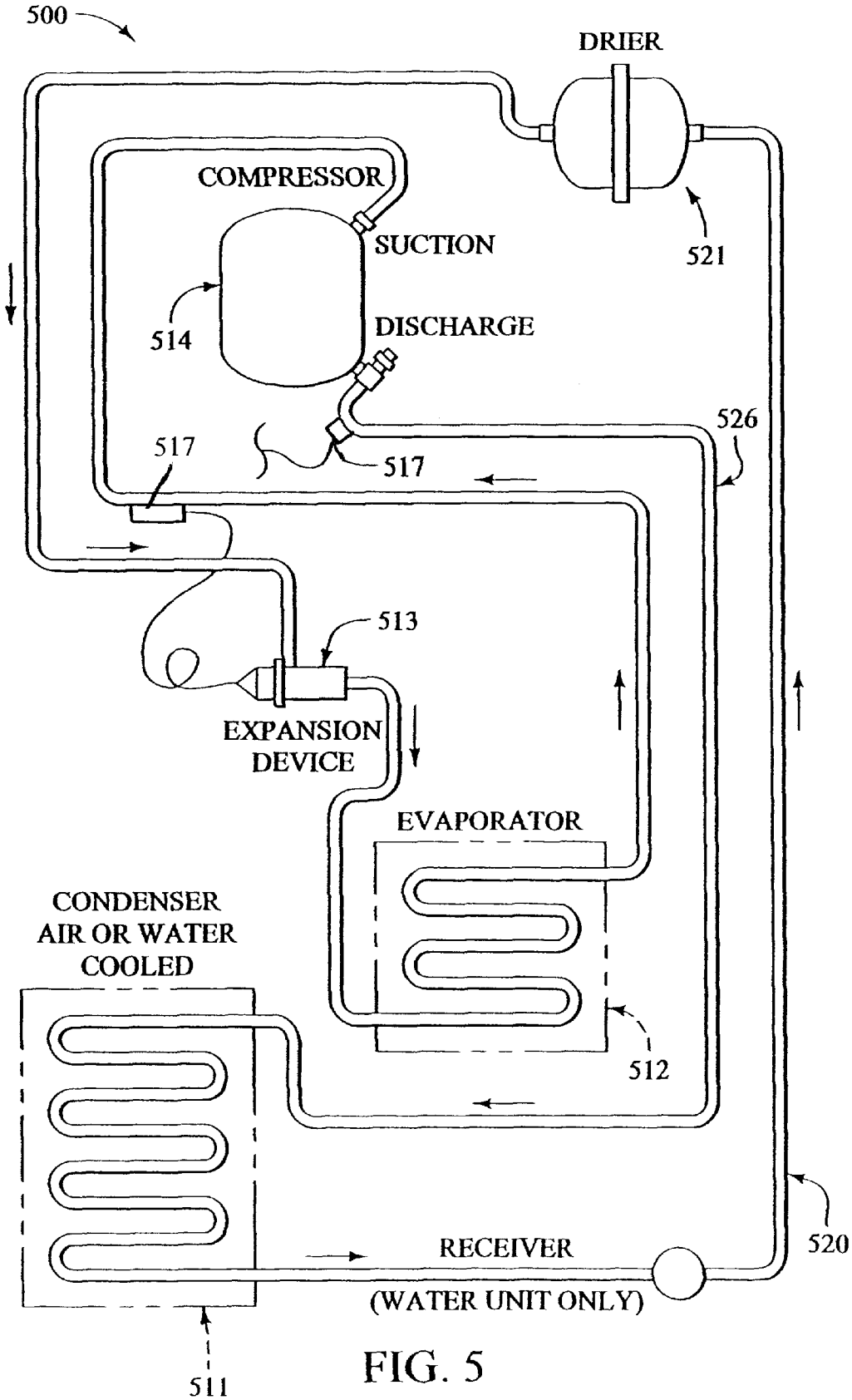
FIG. 5 is a schematic view of the refrigeration system of the flaked ice making machine of FIG. 1.

Although only one evaporator is shown in FIG. 5, the present invention can be applied to ice making machines having two or more evaporators. FIG. 5 also illustrates a refrigerant supply line 520, a drier for the refrigerant 521, and an expansion device 513. The expansion device serves to lower the pressure of the liquid refrigerant. When the compressor 514 is operating, high temperature, high-pressure vaporous refrigerant is forced along a discharge line 526 back to the condenser 511. In one embodiment, a temperature sensor 517 is placed at the discharge of the compressor to monitor the temperature of the compressor discharge. The temperature sensor may be a thermistor or a thermocouple, or other temperature-sensing device as discussed below.

One novel aspect of the invention is to control operation of the flaked ice making machine under conditions that could cause damage to the machine. These conditions could occur, for example, when the ambient temperature is very cold, and the refrigeration system could cause ice to freeze the auger to the freezing cylinder. In another example, a bubble or blockage in the line between the freezing cylinder and the reservoir would not allow fresh, warmer water to reach the freezing cylinder and again, ice could freeze the auger to the freezing cylinder.

In one way of practicing the invention, the controller 262 automatically shuts down compressor 514 upon receiving a signal that the auger 30 is not rotating at a required speed, suggesting a motor malfunction or that the auger 30 is frozen to the inside of the cylinder 28. Another signal causing the compressor to shut down may be that the water reservoir 10 has reached a low level for a certain period of time and has not replenished. Another signal to stop may be indicative of a low temperature signal, or a low-pressure or high-pressure signal, of the refrigeration system. One way of practicing the invention is for the controller 262 to signal the ice-flaker machine to cease making ice if the temperature sensor 517 stays at a low temperature, for instance 68° C., for too long a period, for instance, 30 min., after the ice-flaker machine is started. Alternatively, if the machine has been running under load for a period of time, for a minimum of about 3 min., and the sensor 517 signals too low a temperature, for instance, 68° C., the machine may shut down or signal an alarm, such as a sound or an alarm light. In some embodiments, the low temperature may be in the range of 67 to 69° C.; in other embodiments, and with other compressors, other temperature ranges may be used. The flaked ice machine may also be programmed to shut down if the compressor discharge temperature is too high for a given period of time. This may occur in high ambient conditions or if the compressor is low on refrigerant.

Another signal causing the controller to shut down the machine may be caused by a too-high or too-low voltage supply to the flaked ice machine. Another signal may be a manual signal, as when a switch on the flaked ice machine control panel is turned to "off" or "clean" via switch 320. Another signal to stop may be a TXV flooding signal, or an ice-chute full signal. Another signal may be indicative of too high or too low an ambient temperature level, that is, the temperature environment of the flaked ice machine.

In one embodiment, the flaked ice machine is programmed so that when the controller receives a signal to shut off, it enters a cycle that calls for an off time of about 0.5 hours to about 4 fours, preferably about 2 hours. This is sufficient time for an ice buildup to melt from the cylinder and allow the cylinder to turn freely afterwards. This programmed delay may apply at any shut-down signal, and it may also apply upon a power interruption. The flaked ice machine may also be programmed so that the delay is bypassed whenever a manual override switch is tripped once or twice afterwards. The bypass signal may be given by tripping switch 320 to the "make ice" position, then "off" and then "make ice" again. Other bypass signals may be used.

One method of cleaning the flaked ice machine is to turn the machine to an off or a clean position via switch 320, in which refrigerant is not supplied to the cooling coils, and closing the solenoid inlet valve 414. The ice chute 444 may then be emptied of ice, so that any accidental spillage of cleaning solution will not contaminate the ice. The drain solenoid valve 424 is then opened, draining the freezing cylinder 428 and the water reservoir 410. After the solenoid drain valve 424 is closed, cleaning solution may then be poured manually into the water reservoir 410, with water added simultaneously or afterwards. The outlet line 422 from the water reservoir 410 assures that cleaning solution and water will rise to the same level in both the reservoir 410 and the cylinder 428. A standpipe 421 in one portion of the water reservoir 428 limits the level of the total solution admitted to the freezing cylinder 428 and water reservoir 410.

The solution may then remain for a short period of time in the two vessels, and may then be purged by opening the solenoid drain valve 424. This will clean the reservoir and the cylinder, as well as the connecting lines, of deposited minerals. Next, several rinsing cycles may be performed. In a preferred embodiment, four fill and rinse cycles may be performed to assure that all the cleaning solution is removed. The machine may then be returned to service to make ice. One way of practicing the invention is to gain some mechanical advantage by continuing to rotate the auger 30 during the cleaning cycle, that is, during the filling and flushing operations with cleaning solution and rinsing water. The motion of the auger 30 may help remove the mineral deposits that may well be on the auger itself after it is used to make ice.

One way to practice the invention is to program the controller to go through a cleaning cycle automatically. The cleaning cycle may be programmed to execute after a certain length of time, such as a week or a month, or alternatively, it may be programmed after a predetermined number of hours of making ice, or other predetermined time or count of ice-making cycles. Another way to practice the invention is to manually determine when to clean the flaked ice machine. This manual method may be determined by an examination of the ice made by the ice maker, to determine whether the ice has a high level of impurities, possibly caused by build-up of minerals in the water reservoir or the cylinder. A test or examination of the purity of the inlet and outlet water may also prompt a cleaning cycle. Manual determinations to clean are not limited to these examples, but may include any reason for stopping the production of ice and commencing a cleaning cycle, such as a count of the number of start-ups of the machine, the number of shut-downs of the machine, or the taste of the ice.

While the determination of the cleaning cycle may be manual or automatic, the execution of the cycle preferably remains at least partly manual, in order to better control the distribution of cleaning solution. When the decision is made to clean the flaked ice making machine, cleaning solution is added manually to the water reservoir. While FIG. 4 depicts an orifice 413 with a cap 411 for adding solution to the water reservoir 410, the cleaning solution may be added just as effectively to the freezing cylinder. The controller 262 may then control the flaked ice machine through a series of flush and fill sequences to insure that the flaked ice machine is cleaned and that the cleaning solution is purged.

Figure 6:
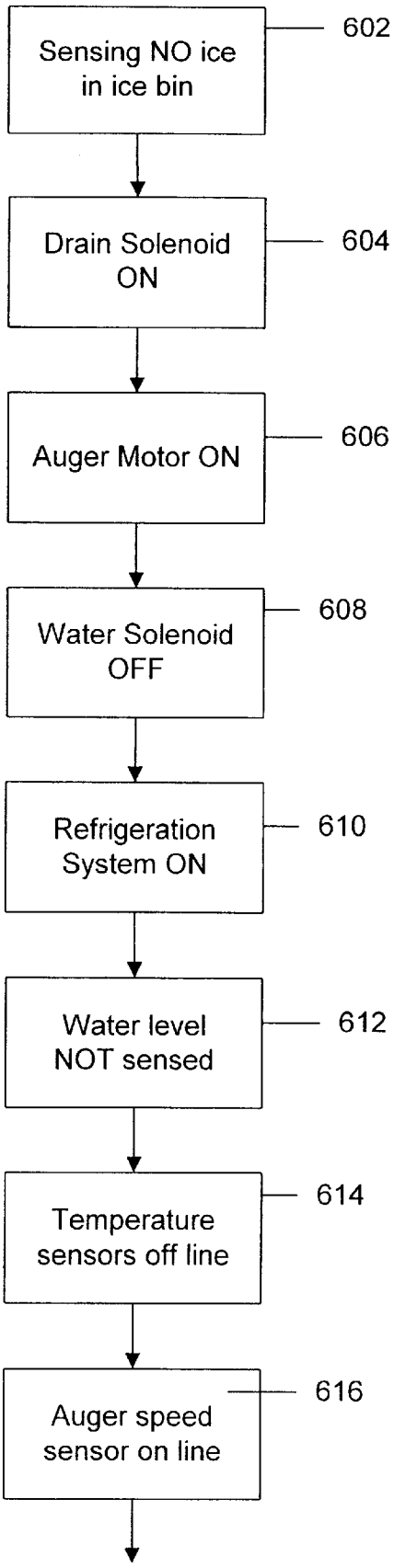
FIGS. 6–12 are flow charts for operating sequences of the flaked ice making machine of FIG. 1 and its control system.

The use of the controller and the sensors may be better understood by reference to FIGS. 6–12, a series of flowcharts or sequences illustrating a preferred use of the systems and sensors for specific tasks performed by the flaked ice machine. FIG. 6 illustrates a water drain sequence, such as would be desirable when first using the machine, or re-starting the machine. In such a sequence, ice bin sensing 602 is sensing no ice in the ice bin, while the drain solenoid 24 would be open or ON 604. The auger motor 40 would be turned ON 606, causing the auger 30 to rotate. The water inlet solenoid 14 would be closed or OFF 608. The refrigeration system 34 may be ON 610. Since the machine is merely flushing at this point, it is not necessary to sense water level in the water reservoir 10 using probes 18, 20, and the water level is therefore not sensed 612. The refrigeration system sensors are OFF 614. Finally, the auger motor 40 should be running, so the auger speed sensor 48 should be online 616.

Figure 7:
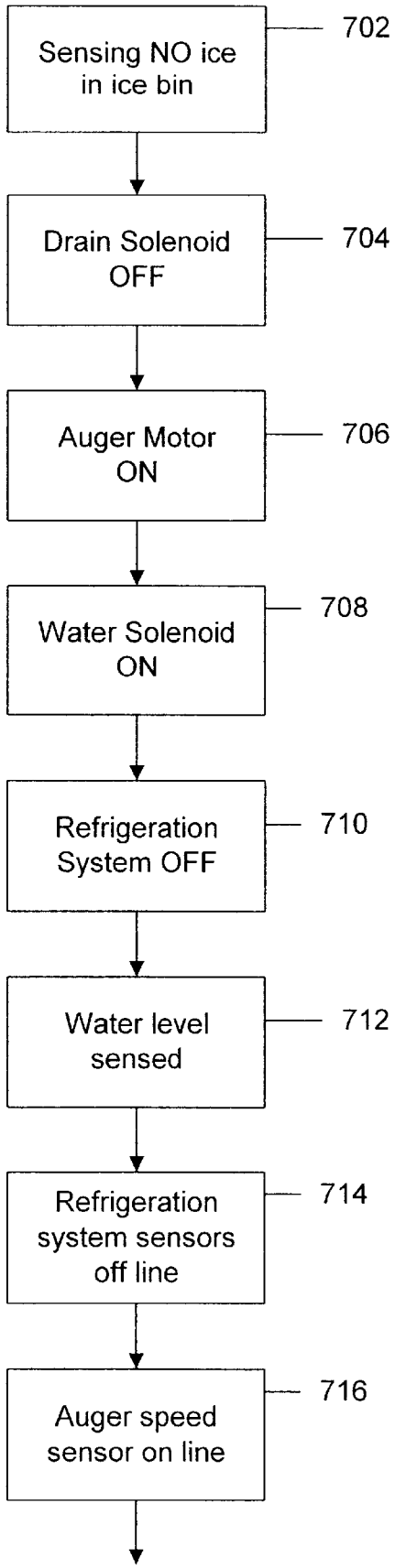

After the flaked ice machine is flushed, the next normal sequence would be to fill the flaked ice machine reservoir 10 with water, as shown in FIG. 7, the water fill sequence. The ice bin level should sense no ice in the ice bin 702, and the drain solenoid 24 should be closed or OFF 704, the auger motor 40 remains ON 706, and the water inlet solenoid 14 is ON 708. The refrigeration system 34 remains OFF 710 since the flaker has still not reached the point of making ice. The water level sensing signals are now turned ON 712 or are considered by the controller 262 if they have been sending a signal during this period. Since the refrigeration system 34 is off at this point, there is no need for sensing refrigeration system sensors and they are off-line 714. The auger motor 40 should be running, so the auger speed sensor 48 should be online 716.

Figure 8:
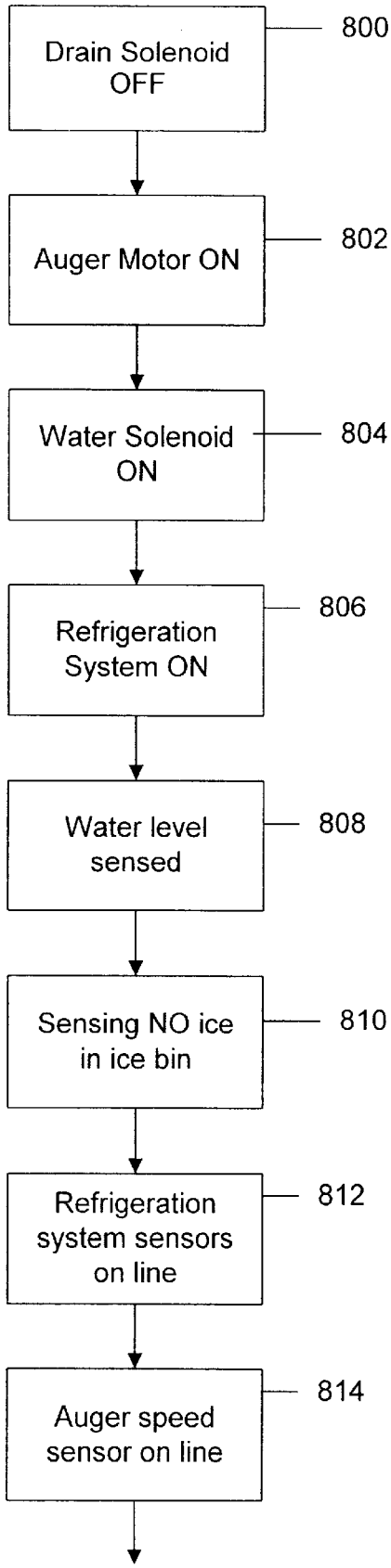

Having now flushed and filled the flaked ice machine with water, the next sequence, shown in FIG. 8, is to start-up the refrigeration system. The drain solenoid remains closed or OFF 800. The auger motor 40 remains ON 802. The water inlet solenoid 14 is ON 804. The refrigeration system is now turned ON 806, as is the water level sensing 808, the ice bin level sensing 810, sensing no ice in the ice bin. The refrigeration system monitoring sensors are on line 812, including temperature sensing device 517 (see FIG. 5). The auger 30 continues to turn, and its speed is monitored 814 by the auger speed sensor 48. As discussed above, the controller 262 will turn OFF the ice machine if the temperature sensed by sensor 517 is too low for too long a period of time.

Figure 9:
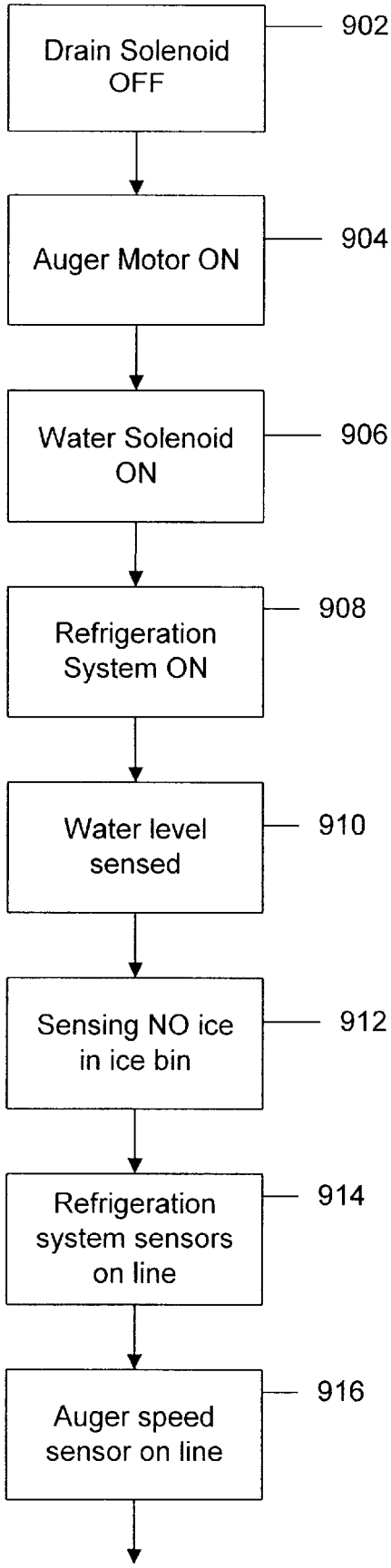

The flaked ice machine is now ready to make ice, via the ice-making sequence depicted in FIG. 9. The drain solenoid 24 remains closed or OFF 902. The auger motor drives the auger, remaining ON 904. The water solenoid is open or ON 906, allowing water to flow to the water reservoir 10 under the control of the float valve 16. The refrigeration system is ON 908, allowing coolant to flow in cooling coils 32 on the outside of the freezing cylinder 28. The water level sensing in the water reservoir remains ON 910. Ice bin level sensing is ON 912, ready to halt ice-making operations if the ice bin fills. Since the refrigeration system is on, the refrigeration system sensor also remains ON 914, as is the auger speed sensor 916.

Figure 10:
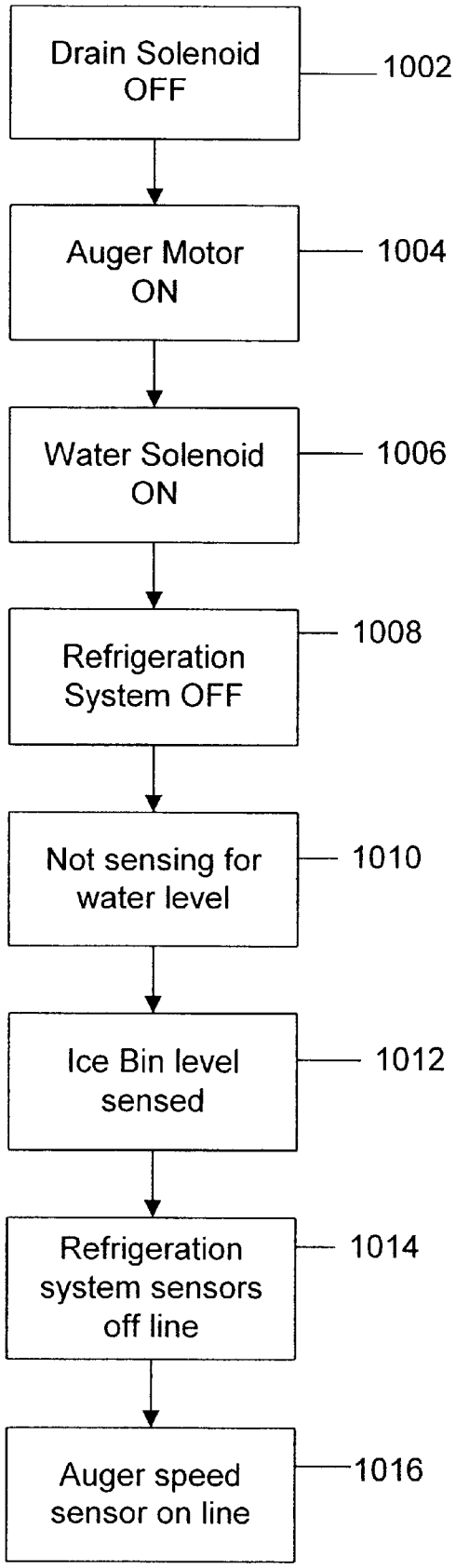

If the ice bin level sensor detects a full ice bin, the machine follows the full ice bin detection sequence depicted in FIG. 10. The point of this sequence is to cease making ice, but in such a manner that the auger does not freeze up inside the cylinder. There is no need to drain the water, so the drain solenoid remains closed or OFF 1002. The auger motor continues to run 1004 for several minutes after the ice bin full is detected, in order to clear itself of ice. The inlet water solenoid opens or is turned ON. The refrigeration system is also turned OFF 1008, since the point of the sequence is to cease ice production. Water level in the reservoir is not sensed 1010, while a level of ice in the ice bin is sensed 1012 by the ice bin sensor. The refrigeration sensors remain off line 1014 during the shutdown. Since the auger continues to turn for several minutes after the detection, the auger speed sensor remains on line 1016. After the refrigeration system shuts down, the water solenoid and the auger may stay on to help remove ice from the flaked ice machine. They may shut off together, and the drain valve may open to drain water from the machine.

Figure 11:
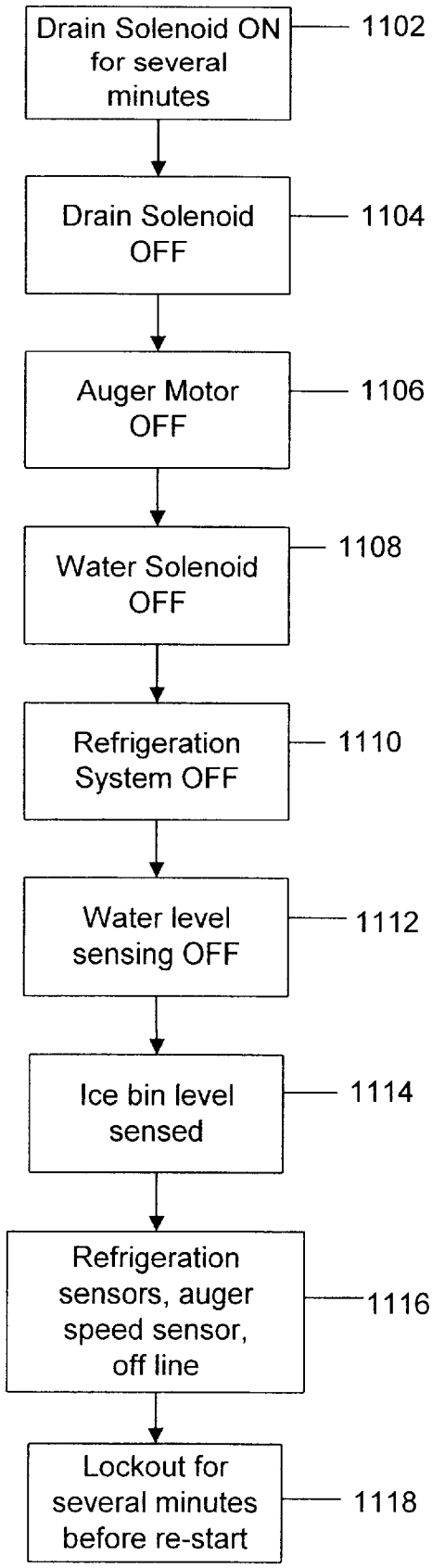

FIG. 11 depicts another sequence of operations if it is desired to shut the flaked ice machine down and to drain the water/ice system. In this sequence, if the ice bin level sensor detects a full ice bin, the flaker shuts down the refrigeration system, drains the water, and is locked out for several minutes before a restart is possible. To drain the water, drain solenoid 24 is open or ON for several minutes 1102. The drain solenoid then turns OFF 1104. The auger motor, running during the drain sequence in order to clear itself of ice is now turned OFF 1106. The inlet water solenoid 14 then closes or is turned OFF 1108. This prevents any more water from entering the reservoir. The refrigeration system 34 is also turned OFF 1110, since the point of the sequence is to cease ice production. Water level in the reservoir is not sensed 1112, but the ice bin sensor remains active 1114. The refrigeration sensors and auger speed sensors are OFF line 1116. The system is then locked out for several minutes before re-start 1118, preventing cycling of the refrigeration system.

Figure 12:
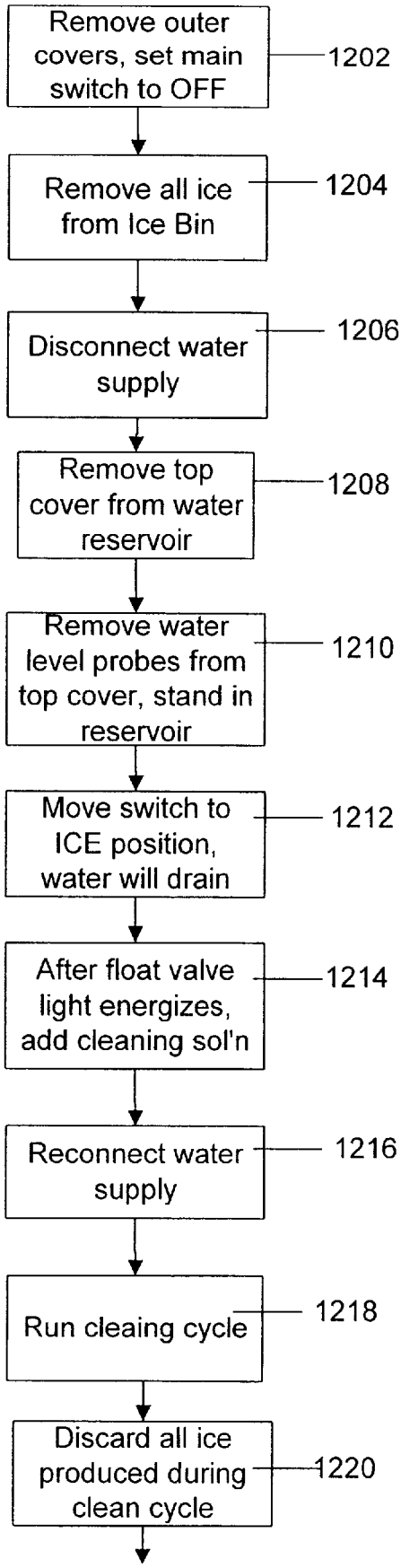

One novel aspect of the invention is the cleaning sequence depicted in FIG. 12 that may be programmed into the controller to clean the flaked ice machine. During a cleaning sequence, the first steps are to remove the outer covers of the flaked ice machine, and set the main switch to OFF 1202. All ice should be removed 1204 from the ice bin. The water supply should be disconnected 1206, preferably by using a quick-disconnect connection. The top cover is then removed from the water reservoir 1208, and the probes removed from top cover and stood in the reservoir 1210. Then the controlling switch may be moved to an ICE position, and the water will drain 1212. After the float valve light energizes, cleaning solution may be added 1214. Then the water supply may be reconnected 1216, and a cleaning cycle run 1218. The cleaning cycle may include several rinses of clean water. In a preferred embodiment, such a rinsing cycle is repeated four times after a cycle in which cleaning solution is used, in order to purge the system of all remnants of the cleaning solution. All ice produced during the clean cycle should be discarded 1220. The machine may then be returned to service.

The cleaning solution is ideally designed to remove mineral deposits remaining after many cycles or hours of freezing water into ice. It will be recognized that it is not necessary to add a cleaning solution in order to benefit from a "flush and fill" sequence. However, the use of a cleaning solution is a preferred embodiment of the method here described.

One aspect of the invention is the ability of the flaked ice machine to undergo this cleaning or flushing sequence when desired, for instance, when an operator of the machine switches the machine to a "clean" cycle via a switch on the machine, as depicted in FIG. 3. Other input devices may be used. An operator of the machine could use a button or a keypad, or an electrical or mechanical input, such as a signal input via another switch or a relay. Another aspect of the machine is the ability to program an automatic flush sequence, such as after a period of time.

While this invention has been shown and described in connection with the preferred embodiments, it is apparent that certain changes and modifications, in addition to those mentioned above may be made from the basic features of this invention. For example, instead of a combination solenoid and float valve, water input to the reservoir could be controlled solely by a solenoid valve and a level sensor. In another example, a refrigeration low temperature of from about 67° C. to about 69° C. is used to signal the ice-flaker machine to shut down; in other embodiments, or with other refrigerants, other temperatures may be used.

Other instruments or sensors may be used to measure desired variables of the flaked ice machine or its auxiliary systems, such as the refrigeration equipment or electrical measurements. Any sensors that will accomplish the missions of detecting motion, or the presence or absence of a level, or a temperature or a pressure, or a voltage or current level, are meant to be included. While certain preferred cycles for operating, shutting down, cleaning, and starting the flaked ice machine are illustrated, other cycles may be used, with other times, or with other sequences. Accordingly, it is the intention of the applicants to protect all variations and modifications within the valid scope of the present invention. It is intended that the invention be defined by the following claims, including all equivalents.

What is claimed is:

1. A machine for making flaked ice, comprising:

a) a water system comprising at least one water inlet, a level control inlet valve and an independently operated inlet valve operably connected to the inlet, the valves in series with the inlet, a reservoir for receiving water from the inlet and the valves, the reservoir also containing at least one water outlet, a freezing cylinder communicating with the water reservoir, the freezing cylinder further comprising an auger having a screw edge and a motor for rotating the auger, and a discharge valve;

b) a refrigeration system comprising a compressor, a condenser, an expansion device and cooling coils in heat transfer relationship with the freezing cylinder for receiving coolant from the expansion device to cool water from the water system; and c) a microprocessor-based controller for controlling the independently operated inlet valve.

2. The ice machine of claim 1 wherein the microprocessor receives inputs from and controls additional components in the water system and refrigeration system in addition to the independently operated inlet valve.

3. The ice machine of claim 1 wherein the independently operated inlet valve is a solenoid valve.

4. The ice machine of claim 1 wherein the level control valve is a float valve.

5. The ice machine of claim 1 further comprising a water level sensor operative to sense at least a low water level in the reservoir.

6. The ice machine of claim 1 further comprising an ice delivery system operative to receive and deliver ice from the freezing cylinder, the ice delivery system having a chute and an ice level sensor for determining an ice level within said chute.

7. The ice machine of claim 6 wherein the ice level sensor has no moving parts and does not block the movement of ice into or out of the chute.

8. The ice machine of claim 1 further comprising an input device for signaling the microprocessor to begin a clean cycle, wherein the microprocessor opens and closes the independently operated inlet valve and the discharge valve.

9. The ice machine of claim 8 wherein the input device is selected from the group consisting of an electrical input, a mechanical input, a switch, a button, and a keypad.

10. The ice machine of claim 1 further comprising an auger speed sensor for determining a speed of the auger.

11. The ice machine of claim 1 further comprising a compressor discharge temperature sensor for sensing a temperature of a discharge of the compressor.

12. The ice machine of claim 1 wherein a removable lid is used to cover the reservoir.

13. A method of operating a flaked ice making machine, comprising:

a) adding water to a reservoir through a solenoid inlet valve in series with a float valve;

b) transferring water from the reservoir to a cylinder containing an auger;

c) rotating the auger;

d) exchanging heat between the water and an environment, wherein the water freezes; and e) removing ice formed by said freezing from said cylinder.

14. The method of claim 13 further comprising ceasing to make ice for a period of from about 0.5 hours to about 4 hours upon a signal from a controller or upon a power interrupt, the period being interruptible by a manual signal from an operator of the flaked ice machine.

15. The method of claim 13 further comprising a step of f) cleaning the flaked ice machine.

16. The method of claim 13 further comprising monitoring a speed of the rotating auger.

17. The method of claim 13 further comprising monitoring at least one variable of a refrigeration system operative to exchange heat between the water and the environment.

18. The method of claim 14 wherein the controller causes the flaked ice machine to cease making ice for at least a period of time upon receiving a signal selected from the group consisting of inputs from the machine and a manual signal.

19. The method of claim 13 wherein the controller causes the flaked ice machine to cease making ice upon receiving a signal indicating a low temperature of a compressor discharge.

20. The method of claim 18 wherein the inputs from the machine are selected from the group consisting of a water level, an auger speed, a compressor discharge temperature, a pressure, a voltage, a count, and a time.

21. The method of claim 18 wherein the controller bypasses the period of time upon receiving a bypass signal.

22. The method of claim 15 wherein the solenoid inlet valve is used to provide repeated rinse cycles during said cleaning.

23. The method of claim 15 wherein cleaning comprises adding a cleaning solution to the reservoir, allowing the solution to transfer to the cylinder, draining the cleaning solution through a drain valve, rinsing at least once with fresh rinse water added through said solenoid and float valves, and draining said fresh water through the drain valve.

24. The method of claim 23 further comprising rotating the auger while the cleaning solution or rinse water is in the reservoir or cylinder.

25. The method of claim 14, further comprising adding a cleaning solution to the cylinder, draining the solution through a drain valve, rinsing at least once with fresh water added through the solenoid valve and float valve, and draining said fresh water through the drain valve.

26. The method of claim 25 further comprising rotating the auger while the cleaning solution or the rinse water is in the cylinder.

27. The method of claim 23 wherein the cleaning starts based on the occurrence of an item selected from the group consisting of a predetermined time, a predetermined count, and a manually determined time.

28. The method of claim 25 wherein the cleaning starts based on the occurrence of an item selected from the group consisting of a predetermined time, a predetermined count, and a manually determined time.

29. The method of claim 13, further comprising monitoring a level of ice in an ice bin and shutting down production of ice when a bin full signal is received.

30. A flaked ice making machine, comprising:

a) a water reservoir, including a water level sensor, a water outlet, and a discharge valve;

b) a water inlet including a float valve and a solenoid inlet valve in series, said valves operably connected to fill the water reservoir;

c) a freezing cylinder operably connected to receive water from said outlet of said water reservoir, said freezing cylinder further comprising an auger having a screw edge therein and a motor to rotate said auger, and cooling coils on the outside thereof connected to a compressor and a condenser for exchanging heat to freeze water inside the cylinder;

d) an ice chute communicating with said cylinder for receiving ice from said freezing cylinder; and e) a controller, wherein said controller is operative to control making of flaked ice by opening and closing said solenoid valve and said discharge valve, and by turning on and off the motor and the compressor.

31. A flaked ice making machine, comprising:

a) a water reservoir, including a water level sensor, a water outlet, and a discharge valve;

b) a water inlet including an inlet float valve and a solenoid inlet valve, operably connected in series to fill the water reservoir;

c) a freezing cylinder operably connected to receive water from said outlet of said water reservoir, said freezing cylinder further comprising an auger having a screw edge therein and a motor to rotate said auger, and cooling coils on the outside thereof connected to a compressor and a condenser for exchanging heat to freeze water inside the cylinder;

d) an ice chute for receiving ice from said freezing cylinder and a capacitive ice chute sensor within the ice chute; and e) a controller operative to control making of flaked ice by closing the water inlet valve and turning off the motor and the compressor upon receiving a signal from the ice chute sensor.

32. An improved flaked ice making machine having a water system with at least one water inlet and an inlet valve operably connected to the inlet, a reservoir for receiving water from the inlet and the valve, said reservoir also containing at least one water outlet, and a freezing cylinder with an auger and the flaked ice machine also having a refrigeration system having cooling coils in thermal contact with the freezing cylinder, wherein the improvement is:

the inlet valve comprises a solenoid valve in series with a level control valve.

33. The flaked ice machine of claim 32 wherein the level control valve is a float valve.

34. An improved flaked ice making machine having a water system with at least one water inlet and an inlet valve operably connected to the inlet, a reservoir for receiving water from the inlet and the valve, said reservoir also containing at least one water outlet, and a freezing cylinder with an auger and the flaked ice machine also having a refrigeration system having cooling coils in thermal contact with the freezing cylinder, wherein the improvement is:

the inlet valve comprises an independently controlled valve in series with a level control valve, wherein the independently controlled inlet valve allows the water system to be drained in a cleaning cycle.

35. The flaked ice machine of claim 32 wherein a further improvement is an ice delivery system comprising a chute and a sensor to monitor the ice level in the chute.

36. An improved flaked ice making machine having a water system with at least one water inlet and an inlet valve operably connected to the inlet, a reservoir for receiving water from the inlet and the valve, said reservoir also containing at least one water outlet, and a freezing cylinder with an auger and the flaked ice machine also having a refrigeration system having cooling coils in thermal contact with the freezing cylinder, wherein the improvement is:

the inlet valve comprises an independently controlled valve in series with a level control valve, and wherein a further improvement is a temperature-sensing device for monitoring a discharge temperature of the compressor to shut off the flaked ice machine if a monitored temperature is too low or too high for a period of time.

37. A flaked ice making machine, comprising:

a) a water reservoir, including a water level sensor, a water outlet and a discharge valve;

b) a water inlet including a combination float and solenoid valve, operably connected to fill the water reservoir;

c) a freezing cylinder operably connected to receive water from said outlet of said water reservoir, said freezing cylinder further comprising an auger having a screw edge therein and a motor to rotate said auger, and cooling coils connected to a refrigeration system including a compressor for exchanging heat to freeze water inside said freezing cylinder;

d) an ice chute communicating with said cylinder for receiving ice from said freezing cylinder; and e) a controller, wherein said controller is operative to control making of flaked ice by opening and closing said solenoid valve and said discharge valve, by turning on and off the motor and the compressor, and wherein the controller turns off the compressor when the compressor signals a low temperature.

38. The flaked ice machine of claim 37 wherein said chute further comprises a capacitive sensor for determining an ice level within said chute.

39. The flaked ice machine of claim 37 wherein said controller further is responsive to clean said flaked ice machine.

40. The flaked ice machine of claim 37 wherein said controller further is responsive to cease making ice for a period of time upon receiving a signal from a motor speed sensor, and wherein the period of time is bypassed by sending a bypass signal to the controller.

41. A flaked ice making machine, comprising:

a) a water reservoir, including a water level sensor, a water outlet and a discharge valve;

b) a water inlet valve operably connected to fill the water reservoir;

c) a freezing cylinder operably connected to receive water from said outlet of said water reservoir, said freezing cylinder further comprising an auger having a screw edge therein and a motor to rotate said auger, and cooling coils on the outside thereof connected to a compressor and a condenser for exchanging heat to freeze water inside the cylinder;

d) an ice chute communicating with said cylinder for receiving ice from said freezing cylinder, said ice chute further comprising a capacitive sensor for determining an ice level within said chute; and e) a controller, wherein said controller is operative to control making of flaked ice by opening and closing said water inlet valve and said discharge valve, and by turning on and off the motor and the compressor.

42. The flaked ice machine of claim 41 wherein the capacitive sensor has no moving parts and does not block the movement of ice into or out of the chute.

* * * * *